US009934716B2

(12) United States Patent
Li et al.

(10) Patent No.: US 9,934,716 B2
(45) Date of Patent: Apr. 3, 2018

(54) DISPLAY AND SUB-PIXEL MATRIX THEREOF

(71) Applicant: Raydium Semiconductor Corporation, Hsinchu (TW)

(72) Inventors: Hung Li, Taipei (TW); Chung-Cheng Chou, Luzhu Township (TW); Ming-Nan Yu, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 37 days.

(21) Appl. No.: 14/814,062

(22) Filed: Jul. 30, 2015

(65) Prior Publication Data

US 2016/0035266 A1 Feb. 4, 2016

(30) Foreign Application Priority Data

Aug. 1, 2014 (TW) ..... 103126451 A

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2300/0452* (2013.01)

(58) Field of Classification Search
CPC .. G09G 5/00; G09G 5/10; G09G 5/02; G09G 3/2003; G09G 3/3666; H03K 19/0175
See application file for complete search history.

(56) References Cited

U.S. PATENT DOCUMENTS

| | | | | |
|---|---|---|---|---|
| 9,626,894 | B2 * | 4/2017 | Gu | G09G 3/2003 |
| 9,679,511 | B2 * | 6/2017 | Gu | G09G 3/2074 |
| 2005/0225575 | A1 * | 10/2005 | Brown Elliott | G02F 1/133514 345/694 |
| 2013/0027437 | A1 * | 1/2013 | Gu | G09G 3/3607 345/690 |
| 2017/0039918 | A1 * | 2/2017 | Tsao | G09G 3/2003 |
| 2017/0061907 | A1 * | 3/2017 | He | G09G 3/3607 |

* cited by examiner

*Primary Examiner* — Lun-Yi Lao
*Assistant Examiner* — Johny Lau

(57) ABSTRACT

A display including a display panel and a control module is disclosed. The display panel includes a plurality of same sub-pixel matrixes. Each sub-pixel matrix is formed by arranging a plurality of sub-pixels. The plurality of sub-pixels includes first sub-pixels corresponding to a first color, second sub-pixels corresponding to a second color, and third sub-pixels corresponding to a third color. The first sub-pixels, the second sub-pixels, and the third sub-pixels are all arranged on the display panel to form a shape of fold line having different folding lengths. The control module is coupled to the display panel and used to output a control signal to the display panel according to a display data to drive the plurality of sub-pixels on the display panel.

12 Claims, 5 Drawing Sheets

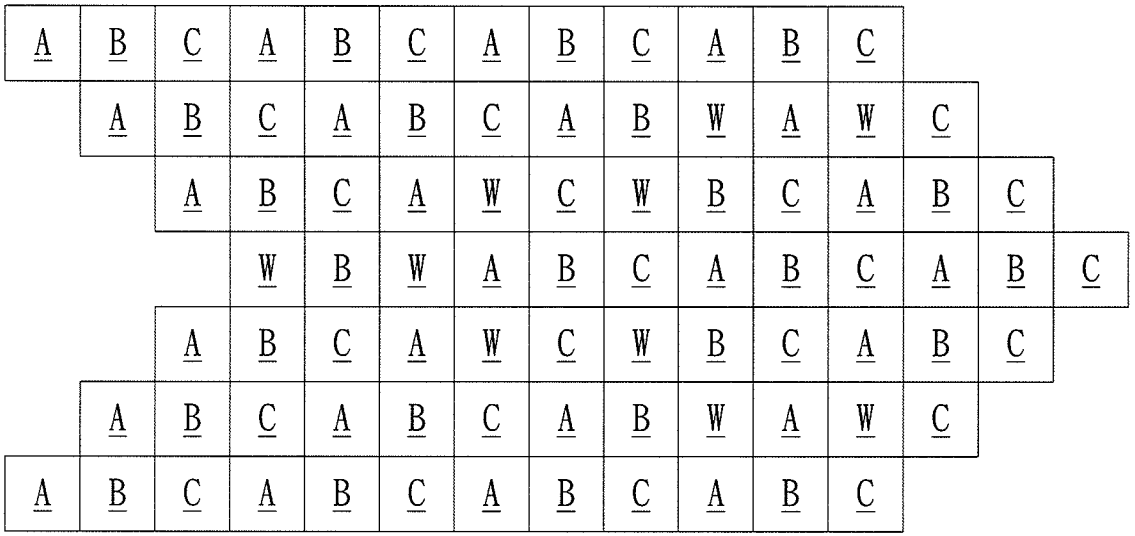
A
B C
A B C
A B C A
A B C A B
A B C A B C
A B C A B C A
A B C A B C A B
A B C A B C A B C
A B C A B C A B C A
A B C A B C A B C A B
A B C A B C A B C A B C
A B C A B C A B C A B C A
A B C A B C A B C A B C A B
A B C A B C A B C A B C A B C
A B C A B C A B C A B C A B C A
A B C A B C A B C A B C A B C A B
A B C A B C A B C A B C A B C A B C
A B C A B C A B C A B C A B C A B C A
A B C A B C A B C A B C A B C A B C A B
A B C A B C A B C A B C A B C A B C A B C
A B C A B C A B C A B C A B C A B C A B C A
A B C A B C A B C A B C A B C A B C A B C A B
A B C A B C A B C A B C A B C A B C A B C A B C
A B C A B C A B C A B C A B C A B C A B C A B C A
A B C A B C A B C A B C A B C A B C A B C A B C A B
A B C A B C A B C A B C A B C A B C A B C A B C A B C
A B C A B C A B C A B C A B C A B C A B C A B C A B C A
A B C A B C A B C A B C A B C A B C A B C A B C A B C A B
A B C A B C A B C A B C A B C A B C A B C A B C A B C A B C
A B C A B C A B C A B C A B C A B C A B C A B C A B C A B C A
A B C A B C A B C A B C A B C A B C A B C A B C A B C A B C A B
A B C A B C A B C A B C A B C A B C A B C A B C A B C A B C A B C
A B C A B C A B C A B C A B C A B C A B C A B C A B C A B C A B C A
A B C A B C A B C A B C A B C A B C A B C A B C A B C A B C A B C A B
A B C A B C A B C A B C A B C A B C A B C A B C A B C A B C A B C A B C
A B C A B C A B C A B C A B C A B C A B C A B C A B C A B C A B C A B C A
A B C A B C A B C A B C A B C A B C A B C A B C A B C A B C A B C A B C A B
A B C A B C A B C A B C A B C A B C A B C A B C A B C A B C A B C A B C A B C
A B C A B C A B C A B C A B C A B C A B C A B C A B C A B C A B C A B C A B C A
A B C A B C A B C A B C A B C A B C A B C A B C A B C A B C A B C A B C A B C A B
A B C A B C A B C A B C A B C A B C A B C A B C A B C A B C A B C A B C A B C A B C
A B C A B C A B C A B C A B C A B C A B C A B C A B C A B C A B C A B C A B C A B C A
A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C A B C A B C A B C A B C A B C
A B C A B C A B C A B C A B C A B C A B C A B C A B C A B C A B C A B C A B C A B C A B C A B C A B C A B C A B C A B C A B C A B C A B C A B C A B C A B C A B C A B C A B C A
A B C A B C A B C A B C A B C A B C A B C A B C A B C A B C A B C A B C A B C A B C A B C A B C A B C A B C A B C A B C A B C A B C A B C A B C A B C A B C A B C A B C A B C A B
A B C A B C A B C A B C A B C A B C A B C A B C A B C A B C A B C A B C A B C A B C A B C A B C A B C A B C A B C A B C A B C A B C A B C A B C A B C A B C A B C A B C A B C A B C
A B C

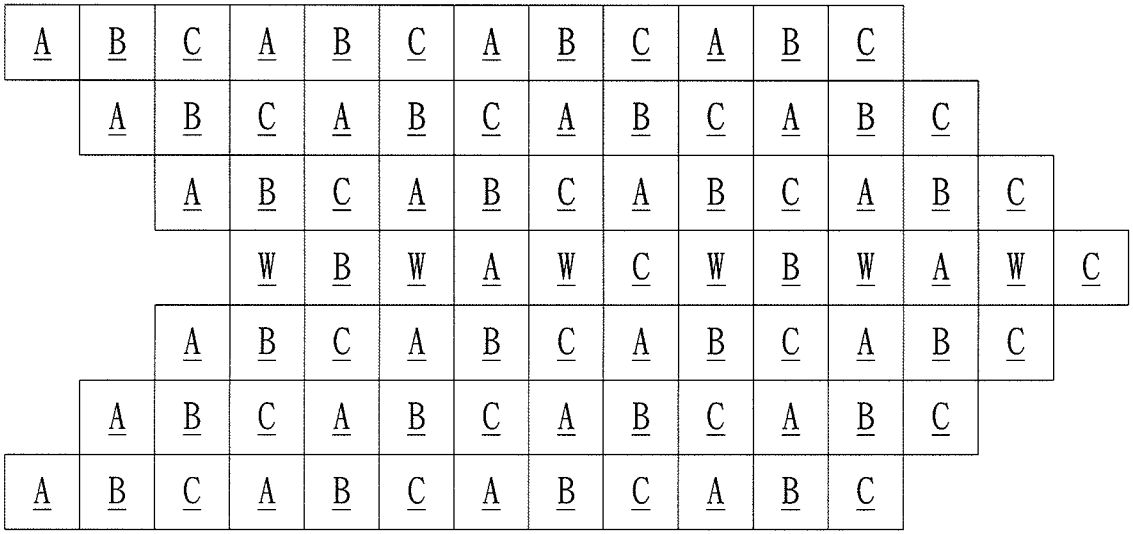
A B C A B C A B C

DISPLAY AND SUB-PIXEL MATRIX THEREOF

BACKGROUND OF THE INVENTION

Field of the Invention

This invention relates to a display, especially to a display and its sub-pixel matrix.

Description of the Related Art

With the progress of display technology, the resolution of the display becomes higher and higher. In general, the resolution of the display represents the number of the pixels per unit area of the panel; for example, the resolution of the display can be (1902*1080). When the value of the resolution of the display becomes higher, it means that the display can show more details of the image.

Taking LCD apparatus for example, each pixel of the conventional LCD panel includes three sub-pixels of three primary colors; as shown in FIG. 1, each pixel P of the conventional LCD panel 1 includes a red sub-pixel R, a green sub-pixel G, and a blue sub-pixel B respectively.

If the red sub-pixel R, the green sub-pixel G, and the blue sub-pixel B of each pixel P are arranged from left to right, then each row of sub-pixels in a horizontal direction on the LCD panel 1 will be arranged from left to right in an order of the red sub-pixel R, the green sub-pixel G, the blue sub-pixel B, the red sub-pixel R, the green sub-pixel G, the blue sub-pixel B . . . and so forth. Each column of sub-pixels in a perpendicular direction on the LCD panel 1 will be arranged from top to bottom in an order of the red sub-pixel R, the green sub-pixel G, the blue sub-pixel B, the red sub-pixel R, the green sub-pixel G, the blue sub-pixel B . . . and so forth.

The above-mentioned sub-pixel arrangement of the conventional LCD panel 1 can achieve color averaging of the sub-pixels along the horizontal direction of the LCD panel 1; however, as shown in FIG. 1, since each column of sub-pixels has the same color and adjacent columns of sub-pixels have different colors along the perpendicular direction of the LCD panel 1, it is hard to achieve color averaging of the sub-pixels along the perpendicular direction of the LCD panel 1.

Therefore, the invention provides a display and its sub-pixel matrix to solve the above-mentioned problems.

SUMMARY OF THE INVENTION

A preferred embodiment of the invention is a display. In this embodiment, the display includes a display panel and a control module. The display panel includes a plurality of same sub-pixel matrixes. Each sub-pixel matrix is formed by arranging a plurality of sub-pixels. The plurality of sub-pixels includes first sub-pixels corresponding to a first color, second sub-pixels corresponding to a second color, and third sub-pixels corresponding to a third color. The first sub-pixels, the second sub-pixels, and the third sub-pixels are all arranged on the display panel to form a shape of fold line having different folding lengths. The control module is coupled to the display panel and used to output a control signal to the display panel according to a display data to drive the plurality of sub-pixels on the display panel.

In an embodiment, the first color is red, the second color is green, and the third color is blue; the first color is red, the second color is blue, and the third color is green; the first color is green, the second color is red, and the third color is blue; the first color is green, the second color is blue, and the third color is red; the first color is blue, the second color is green, and the third color is red; the first color is blue, the second color is red, and the third color is green.

In an embodiment, the shape of fold line having different folding lengths formed by arranging the plurality of first sub-pixels, the plurality of second sub-pixels, and the plurality of third sub-pixels on the display panel is a lightning-like shape.

In an embodiment, the sub-pixel matrix comprises 24 sub-pixels arranged in a specific order, the 24 sub-pixels comprise 8 first sub-pixels represented by A, 8 second sub-pixels represented by B, and 8 third sub-pixels represented by C, and the specific order is

ABC
CAB
ABC
BCA
ABC
BCA
ABC
CAB.

In an embodiment, an arrangement of any two adjacent rows of sub-pixels produces a stagger in the specific order.

In an embodiment, at least one sub-pixel among the plurality of first sub-pixels, the plurality of second sub-pixels, and the plurality of third sub-pixels of the sub-pixel matrix is replaced by at least one fourth sub-pixel corresponding to a fourth color.

In an embodiment, the fourth color is white.

Another preferred embodiment of the invention is a sub-pixel matrix. In this embodiment, the sub-pixel matrix is disposed on a display panel of a display. The display panel is coupled to a control module. The sub-pixel matrix includes a plurality of sub-pixels. The plurality of sub-pixels includes a plurality of first sub-pixels corresponding to a first color, a plurality of second sub-pixels corresponding to a second color, and a plurality of third sub-pixels corresponding to a third color. The plurality of first sub-pixels, the plurality of second sub-pixels, and the plurality of third sub-pixels are all arranged on the display panel to form a shape of fold line having different folding lengths. The control module outputs a control signal to the display panel according to a display data to drive the plurality of sub-pixels on the display panel.

Compared with the prior arts, in the display and its sub-pixel matrix of the invention, sub-pixels of the same color will be arranged in each column of the LCD panel, but the sub-pixels of the same color arranged in each column of the LCD panel will not be adjacent to each other in the perpendicular direction; therefore, the sub-pixels of the same color will be arranged on the display panel to form a shape of fold line having different folding lengths similar to a lightning-like shape, so that the sub-pixel arrangement of the LCD panel can achieve color averaging of the sub-pixels along both the horizontal direction and the perpendicular direction of the LCD panel. In addition, the invention also provides different ways of staggering sub-pixels or replacing some red sub-pixels, green sub-pixels, or blue sub-pixels by white sub-pixels to generate different sub-pixel arrangements to increase the brightness of the display.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 5, FIG. 6, FIG. 7, and FIG. 8 illustrate different embodiments of sub-pixel arrangements on the display of the invention respectively.

DETAILED DESCRIPTION

A preferred embodiment of the invention is a display. In this embodiment, the display can be a monitor, a TV, a screen disposed on any electronic apparatus such as a notebook, a tablet PC, a smart phone, a conventional feature phone . . . and so on, but not limited to this.

Figure 2:
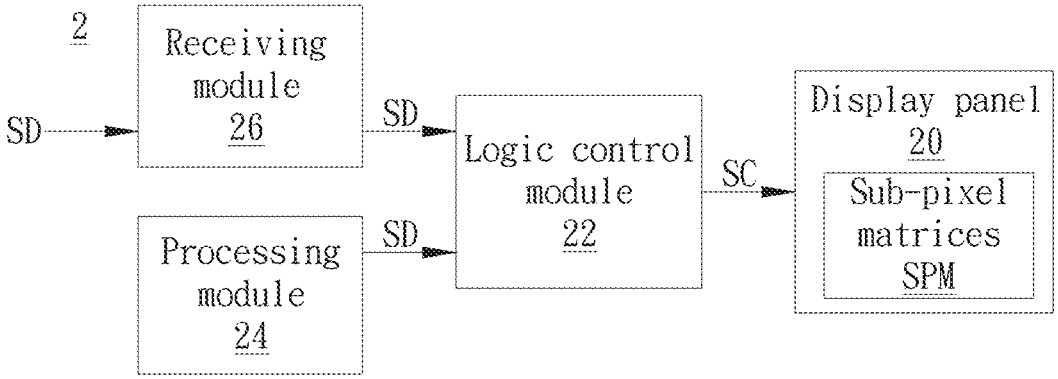
FIG. 2 illustrates a functional block diagram of the display in an embodiment of the invention.

Please refer to FIG. 2. FIG. 2 illustrates a functional block diagram of the display in this embodiment.

As shown in FIG. 2, the display 2 of this embodiment is a LCD display. The display 2 includes a display panel 20 having sun-pixel matrices SPM, a logic control module 22, a processing module 24, and a receiving module 26. The logic control module 22 is coupled to the display panel 20; the processing module 24 and the receiving module 26 are coupled to the logic control module 22 respectively.

The receiving module 26 receives a display data SD and provides the display data SD to the logic control module 22. In practical applications, the receiving module 26 can be an antenna, a RF receiver, a Bluetooth receiver, a Wi-Fi receiver, a digital signal tuner, a digital display signal connector (e.g., HDMI, DVI, Display Port), or Ethernet interface, but not limited to this.

The processing module 24 generates the display data SD in a form of frames and directly provides the display data SD to the logic control module 22. In practical applications, the processing module 24 can be a CPU, a GPU, a MCU, and the processing module 24 can generate a control command pr a test signal, but not limited to this.

The logic control module 22 receives the display data SD from the receiving module 26 or a processing module 24 and outputs a control signal SC to the display panel 20 having the sun-pixel matrices SPM according to the display data SD, so that the sun-pixel matrices SPM on the display panel 20 can be driven. In practical applications, the logic control module 22 can be any logic control circuits, hardware, software, or their combinations; the logic control module 22 can include any suitable elements, such as coder, decoder, processor, timing controller, storage unit, but not limited to this.

Figure 3:
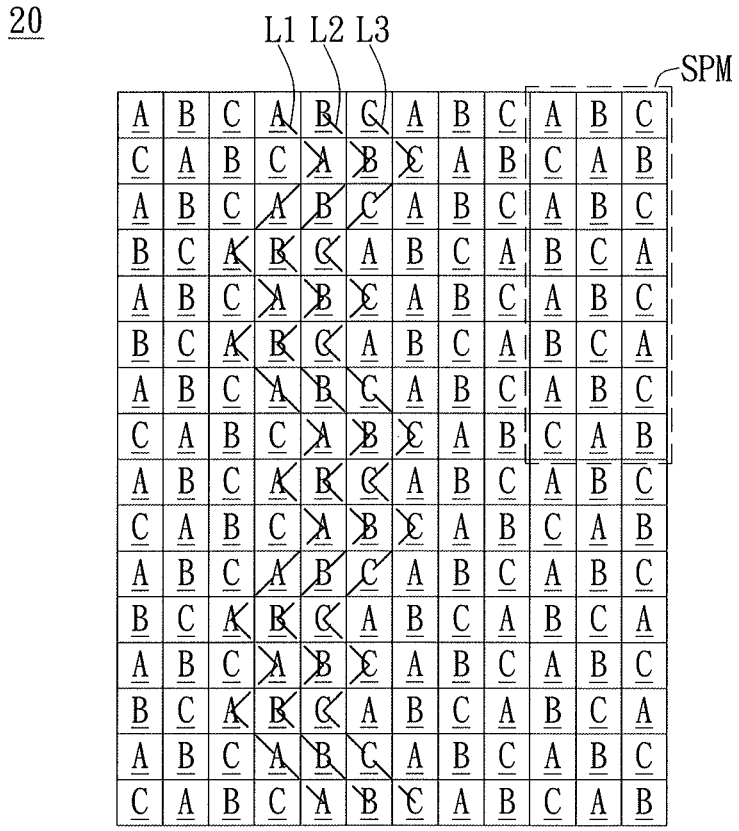
FIG. 3 illustrates a schematic diagram of the arrangement of the sub-pixel matrix on the display in an embodiment of the invention.
Figure 4:
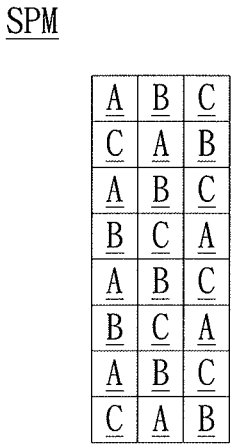
FIG. 4 illustrates a schematic diagram of the sub-pixel matrix in FIG. 3 of the invention.

FIG. 3 illustrates a schematic diagram of the arrangement of the sub-pixel matrices SPM on the display 20 of FIG. 2. FIG. 4 illustrates a schematic diagram of the sub-pixel matrix SPM in FIG. 3.

As shown in FIG. 3, the sub-pixel matrices SPM are all the same and arranged along a horizontal direction and a perpendicular direction respectively. As shown in FIG. 4, the sub-pixel matrix SPM includes a first sub-pixel A corresponding to a first color, a second sub-pixel B corresponding to a second color, and a third sub-pixel C corresponding to a third color.

In this embodiment, the first color is red, the second color is green, and the third color is blue; or the first color is red, the second color is blue, and the third color is green; or the first color is green, the second color is red, and the third color is blue; or the first color is green, the second color is blue, and the third color is red; or the first color is blue, the second color is green, and the third color is red; or the first color is blue, the second color is red, and the third color is green, but not limited to this.

As shown in FIG. 4, in the horizontal direction, the sub-pixel matrix SPM includes 8 rows of sub-pixels and each row of sub-pixels includes 3 sub-pixels. These 8 rows of sub-pixels are arranged in an order of

ABC
CAB
ABC
BCA
ABC
BCA
ABC
CAB.

In the sub-pixel matrix SPM, the first row of sub-pixels, the third row of sub-pixels, the fifth row of sub-pixels, and the seventh row of sub-pixels are arranged in the same order of ABC; the second row of sub-pixels and the eighth row of sub-pixels are arranged in the same order of CAB; the fourth row of sub-pixels and the sixth row of sub-pixels are arranged in the same order of BCA.

As shown in FIG. 4, each of the 8 rows includes the first sub-pixel A corresponding to the first color, the second sub-pixel B corresponding to the second color, and the third sub-pixel C corresponding to the third color. In each row of sub-pixels, the first sub-pixel A corresponding to the first color, the second sub-pixel B corresponding to the second color, and the third sub-pixel C corresponding to the third color are not repeated.

On the other hand, in the perpendicular direction, the sun-pixel matrix SPM includes 3 columns of sub-pixels and each column of sub-pixels includes 8 sub-pixels. These 3 columns of sub-pixels are arranged in an order of

ACABABAC
BABCBCBA
CBCACACB.

In the first row of sub-pixels, the arranging order of the sub-pixels from top to bottom is ACABABAC, wherein the first sub-pixel, the third sub-pixel, the fifth sub-pixel, and the seventh sub-pixel are all first sub-pixels A corresponding to the first color; the second sub-pixel and the eighth sub-pixel are both third sub-pixels C corresponding to the third color; the fourth sub-pixel and the sixth sub-pixel are both second sub-pixels B corresponding to the second color.

In the second row of sub-pixels, the arranging order of the sub-pixels from top to bottom is BABCBCBA, wherein the first sub-pixel, the third sub-pixel, the fifth sub-pixel, and the seventh sub-pixel are all second sub-pixels B corresponding to the second color; the second sub-pixel and the eighth sub-pixel are both first sub-pixels A corresponding to the first color; the fourth sub-pixel and the sixth sub-pixel are both third sub-pixels C corresponding to the third color.

In the third row of sub-pixels, the arranging order of the sub-pixels from top to bottom is CBCACACB, wherein the first sub-pixel, the third sub-pixel, the fifth sub-pixel, and the seventh sub-pixel are all third sub-pixels C corresponding to the third color; the second sub-pixel and the eighth sub-pixel are both second sub-pixels B corresponding to the second color; the fourth sub-pixel and the sixth sub-pixel are both first sub-pixels A corresponding to the first color.

In the sub-pixel matrix SPM, each of the 3 rows includes at least two first sub-pixels A corresponding to the first color, at least two second sub-pixels B corresponding to the second color, and at least two third sub-pixels C corresponding to the third color. That is to say, each row includes at least two red sub-pixels, at least two green sub-pixels, and at least two blue sub-pixels. In addition, sub-pixels of the same color will not be arranged adjacent to each other. Instead, sub-pixels of different colors are arranged in a staggering form.

Then, please refer back to FIG. 3. The distribution of the sub-pixels of the same color on the display panel 20 is introduced.

As shown in FIG. 3, dotted lines L1, L2, and L3 represent the distribution of the first sub-pixels A corresponding to the first color, the second sub-pixels B corresponding to the second color, and the third sub-pixels C corresponding to the third color on the display panel 20.

As to the dotted line L1, in the perpendicular direction, the fourth row of sub-pixels on the display panel 20 is used as a center for the dotted line L1 to bend left toward the third row of sub-pixels and bend right toward the fifth row of sub-pixels in a staggering form, so that the dotted line L1 has a shape of fold line having different folding lengths similar to a lightning-like shape to show the distribution of the first sub-pixel A on the display panel 20.

In detail, on the display panel 20, the dotted line L1 starts to bend right from the first sub-pixel A at the first position of the fourth row of sub-pixels to the first sub-pixel A at the second position of the fifth row of sub-pixels, and then bend left to the first sub-pixel A at the third position of the fourth row of sub-pixels. Then, the dotted line L1 bends left from the first sub-pixel A at the third position of the fourth row of sub-pixels to the first sub-pixel A at the fourth position of the third row of sub-pixels, and then bends right to the first sub-pixel A at the fifth position of the fourth row of sub-pixels. Afterward, the dotted line L1 bends left from the first sub-pixel A at the fifth position of the fourth row of sub-pixels to the first sub-pixel A at the sixth position of the third row of sub-pixels, and then bends right to the first sub-pixel A at the seventh position of the fourth row of sub-pixels. Then, the dotted line L1 bends right from the first sub-pixel A at the seventh position of the fourth row of sub-pixels to the first sub-pixel A at the eighth position of the fifth row of sub-pixels, and then bends left to the first sub-pixel A at the ninth position of the fourth row of sub-pixels, and so on.

As to the dotted line L2, in the perpendicular direction, the fifth row of sub-pixels on the display panel 20 is used as a center for the dotted line L2 to bend left toward the fourth row of sub-pixels and bend right toward the sixth row of sub-pixels in a staggering form, so that the dotted line L2 has a shape of fold line having different folding lengths similar to a lightning-like shape to show the distribution of the first sub-pixel B on the display panel 20.

In detail, on the display panel 20, the dotted line L2 starts to bend right from the second sub-pixel B at the first position of the fifth row of sub-pixels to the second sub-pixel B at the second position of the sixth row of sub-pixels, and then bend left to the second sub-pixel B at the third position of the fifth row of sub-pixels. Then, the dotted line L1 bends left from the second sub-pixel B at the third position of the fifth row of sub-pixels to the second sub-pixel B at the fourth position of the fourth row of sub-pixels, and then bends right to the second sub-pixel B at the fifth position of the fifth row of sub-pixels. Afterward, the dotted line L1 bends left from the second sub-pixel B at the fifth position of the fifth row of sub-pixels to the second sub-pixel B at the sixth position of the fourth row of sub-pixels, and then bends right to the second sub-pixel B at the seventh position of the fifth row of sub-pixels. Then, the dotted line L1 bends right from the second sub-pixel B at the seventh position of the fifth row of sub-pixels to the second sub-pixel B at the eighth position of the sixth row of sub-pixels, and then bends left to the second sub-pixel B at the ninth position of the fifth row of sub-pixels, and so on.

As to the dotted line L3, in the perpendicular direction, the sixth row of sub-pixels on the display panel 20 is used as a center for the dotted line L3 to bend left toward the fifth row of sub-pixels and bend right toward the seventh row of sub-pixels in a staggering form, so that the dotted line L3 has a shape of fold line having different folding lengths similar to a lightning-like shape to show the distribution of the first sub-pixel C on the display panel 20.

In detail, In detail, on the display panel 20, the dotted line L2 starts to bend right from the third sub-pixel C at the first position of the sixth row of sub-pixels to the third sub-pixel C at the second position of the seventh row of sub-pixels, and then bend left to the third sub-pixel C at the third position of the sixth row of sub-pixels. Then, the dotted line L1 bends left from the third sub-pixel C at the third position of the sixth row of sub-pixels to the third sub-pixel C at the fourth position of the fifth row of sub-pixels, and then bends right to the third sub-pixel C at the fifth position of the sixth row of sub-pixels. Afterward, the dotted line L1 bends left from the third sub-pixel C at the fifth position of the sixth row of sub-pixels to the third sub-pixel C at the sixth position of the fifth row of sub-pixels, and then bends right to the third sub-pixel C at the seventh position of the sixth row of sub-pixels. Then, the dotted line L1 bends right from the third sub-pixel C at the seventh position of the sixth row of sub-pixels to the third sub-pixel C at the eighth position of the seventh row of sub-pixels, and then bends left to the third sub-pixel C at the ninth position of the sixth row of sub-pixels, and so on.

According to the above-mentioned dotted lines L1~L3, it can be found that the arrangements of the first sub-pixels A corresponding to the first color, the second sub-pixels B corresponding to the second color, and the third sub-pixels C corresponding to the third color on the display panel 20 are irregular fold lines having different folding lengths similar to a lightning-like shape instead of being regular fold lines having the same folding length similar to a sawtooth-like shape. In addition, compared to each column of sub-pixels on the conventional LCD panel 1 of FIG. 1 only including sub-pixels corresponding to one color, each column of sub-pixels on the LCD panel 20 of the invention includes sub-pixels corresponding to all three colors, and the left bending distance and the right bending distance of the sub-pixel of each color on the display panel 20 are substantially the same; therefore, the display panel 20 can achieve color averaging of the sub-pixels in both perpendicular direction and horizontal direction.

Please refer to FIG. 5, FIG. 6, FIG. 7, and FIG. 8. FIG. 5, FIG. 6, FIG. 7, and FIG. 8 illustrate different embodiments of sub-pixel arrangements on the display of the invention respectively.

Figure 1:
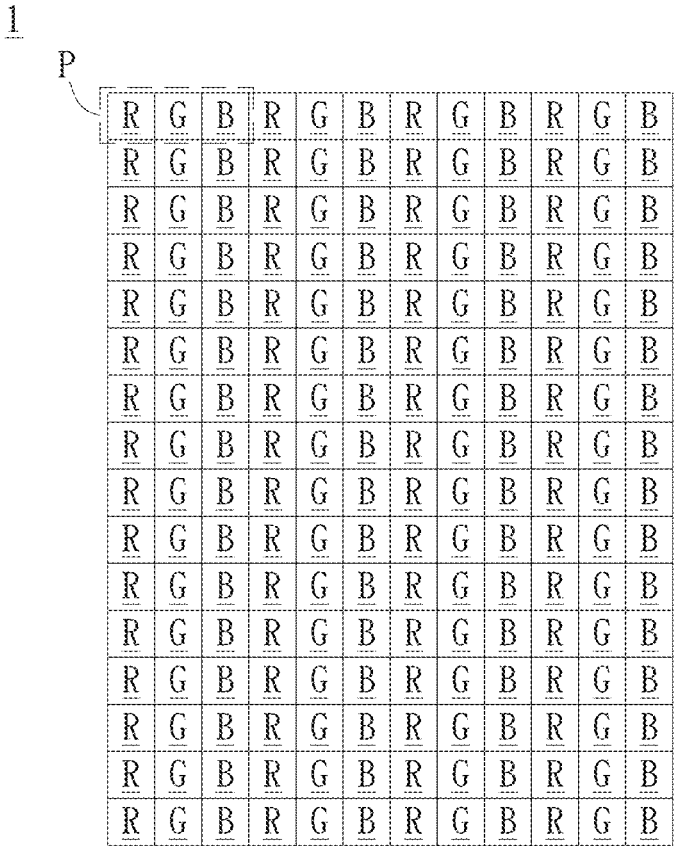
FIG. 1 (PRIOR ART)
FIG. 1 illustrates a schematic diagram of sub-pixel arrangement on the conventional LCD panel.
Figure 5:
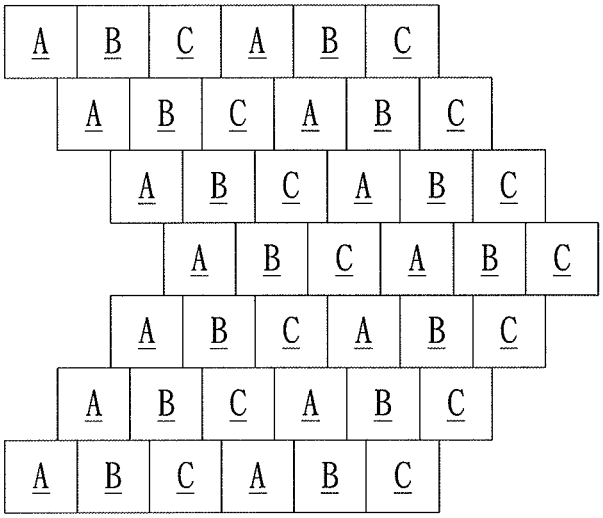

As shown in FIG. 5, different from the prior arts shown in FIG. 1, each row of sub-pixels of this embodiment is staggered to form the sub-pixel arrangement shown in FIG. 5.

Taking the second sub-pixels B corresponding to the second color for example, compared to the second sub-pixel B in the first row, the second sub-pixel B in the second row moves right a distance less than 1 pixel; therefore, a part of the second sub-pixel B in the second row is connected with the second sub-pixel B in the first row and another part of the second sub-pixel B in the second row is connected with the third sub-pixel C in the first row.

Similarly, compared to the second sub-pixel B in the second row, the second sub-pixel B in the third row moves right a distance less than 1 pixel; therefore, a part of the second sub-pixel B in the third row is connected with the second sub-pixel B in the second row and another part of the second sub-pixel B in the third row is connected with the third sub-pixel C in the second row; compared to the second sub-pixel B in the third row, the second sub-pixel B in the fourth row moves right a distance less than 1 pixel; therefore, a part of the second sub-pixel B in the fourth row is connected with the second sub-pixel B in the third row and another part of the second sub-pixel B in the fourth row is connected with the third sub-pixel C in the third row.

Compared to the second sub-pixel B in the fourth row, the second sub-pixel B in the fifth row moves left a distance less than 1 pixel to correspond the second sub-pixel B in the third row; therefore, a part of the second sub-pixel B in the fifth row is connected with the second sub-pixel B in the fourth row and another part of the second sub-pixel B in the fifth row is connected with the first sub-pixel A in the fourth row.

Similarly, compared to the second sub-pixel B in the fifth row, the second sub-pixel B in the sixth row moves left a distance less than 1 pixel to correspond the second sub-pixel B in the second row; therefore, a part of the second sub-pixel B in the sixth row is connected with the second sub-pixel B in the fifth row and another part of the second sub-pixel B in the sixth row is connected with the first sub-pixel A in the fifth row; compared to the second sub-pixel B in the sixth row, the second sub-pixel B in the seventh row moves left a distance less than 1 pixel to correspond the second sub-pixel B in the first row; therefore, a part of the second sub-pixel B in the seventh row is connected with the second sub-pixel B in the sixth row and another part of the second sub-pixel B in the seventh row is connected with the first sub-pixel A in the sixth row.

As to the arrangements of the first sub-pixel A corresponding to the first color and the third sub-pixel C corresponding to the third color, they are similar to the above-mentioned arrangement of the second sub-pixel B corresponding to the second color.

Figure 6:
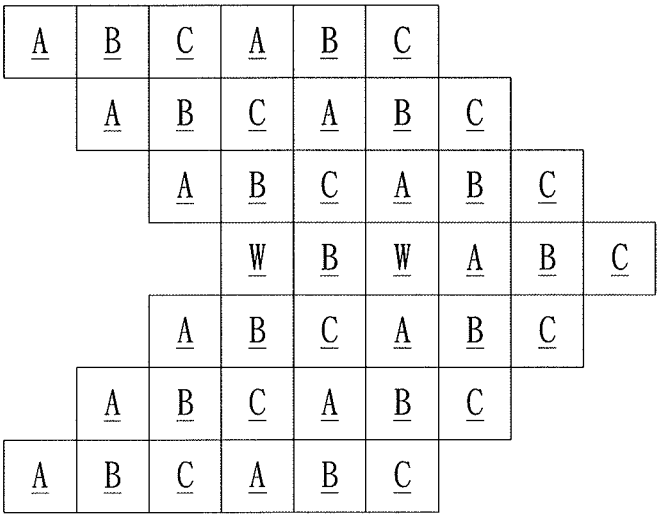

As shown in FIG. 6, different from the prior art shown in FIG. 1, the sub-pixels in this embodiment not only includes first sub-pixels A corresponding to the first color, second sub-pixels B corresponding to the second color, and third sub-pixels C corresponding to the third color, but also includes fourth sub-pixels W corresponding to a fourth color.

Taking the second sub-pixels B corresponding to the second color for example, compared to the second sub-pixel B in the first row, the second sub-pixel B in the second row moves right a distance of 1 pixel; therefore, the second sub-pixel B in the second row is only connected with the third sub-pixel C in the first row instead of being connected with the second sub-pixel B in the first row.

Similarly, compared to the second sub-pixel B in the second row, the second sub-pixel B in the third row moves right a distance of 1 pixel; therefore, the second sub-pixel B in the third row is only connected with the third sub-pixel C in the second row instead of being connected with the second sub-pixel B in the second row; compared to the second sub-pixel B in the third row, the second sub-pixel B in the fourth row moves right a distance of 1 pixel; therefore, the second sub-pixel B in the fourth row is only connected with the third sub-pixel C in the third row instead of being connected with the second sub-pixel B in the third row.

Compared to the second sub-pixel B in the fourth row, the second sub-pixel B in the fifth row moves left a distance of 1 pixel to correspond the second sub-pixel B in the third row; therefore, the second sub-pixel B in the fifth row is only connected with the fourth sub-pixel W in the fourth row instead of being connected with the second sub-pixel B in the fourth row.

Similarly, compared to the second sub-pixel B in the fifth row, the second sub-pixel B in the sixth row moves left a distance of 1 pixel to correspond the second sub-pixel B in the second row; therefore, the second sub-pixel B in the sixth row is only connected with the first sub-pixel A in the fifth row instead of being connected with the second sub-pixel B in the fifth row; compared to the second sub-pixel B in the sixth row, the second sub-pixel B in the seventh row moves left a distance of 1 pixel to correspond the second sub-pixel B in the first row; therefore, the second sub-pixel B in the seventh row is only connected with the first sub-pixel A in the sixth row instead of being connected with the second sub-pixel B in the sixth row.

In practical applications, there will be 6 possible color combinations for the first color corresponding to the first sub-pixel A, the second color corresponding to the second sub-pixel B, and the third color corresponding to the third sub-pixel C a s follows: the first color is red, the second color is green, and the third color is blue; or the first color is red, the second color is blue, and the third color is green; or the first color is green, the second color is red, and the third color is blue; or the first color is green, the second color is blue, and the third color is red; or the first color is blue, the second color is green, and the third color is red; or the first color is blue, the second color is red, and the third color is green, but not limited to this.

In this embodiment, the fourth color corresponding to the fourth sub-pixels W is white, and the positions and numbers of the fourth sub-pixels W on the display panel have no specific limitations. For example, the first sub-pixel A and the third sub-pixel C in the original fourth row of sub-pixels are replaced by two fourth sub-pixels W as shown in FIG. 6; more different sub-pixels in the original sub-pixel arrangement are replaced by more fourth sub-pixels W as shown in FIG. 7 and FIG. 8 respectively to increase the brightness of the display panel.

It should be noticed that, for the sake of symmetry, the positions of the fourth sub-pixels W disposed in the first row of sub-pixels, the second row of sub-pixels, and the third row of sub-pixels and the positions of the fourth sub-pixels W disposed in the fifth row of sub-pixels, the sixth row of sub-pixels, and the seventh row of sub-pixels will be symmetrical in the fourth row of sub-pixels, but not limited to this.

Compared with the prior arts, in the display and its sub-pixel matrix of the invention, sub-pixels of the same color will be arranged in each column of the LCD panel, but the sub-pixels of the same color arranged in each column of the LCD panel will be not adjacent to each other in the perpendicular direction; therefore, the sub-pixels of the same color will be arranged on the display panel to form a shape of fold line having different folding lengths similar to a lightning-like shape, so that the sub-pixel arrangement of the LCD panel can achieve color averaging of the sub-pixels along both the horizontal direction and the perpendicular direction of the LCD panel. In addition, the invention also provides different ways of staggering sub-pixels or replacing some red sub-pixels, green sub-pixels, or blue sub-pixels by white sub-pixels to generate different sub-pixel arrangements to increase the brightness of the display.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A display, comprising:

a display panel comprising a plurality of same sub-pixel matrixes, wherein each sub-pixel matrix comprises a plurality of sub-pixels, the plurality of sub-pixels comprises a plurality of first sub-pixels corresponding to a first color, a plurality of second sub-pixels corresponding to a second color, and a plurality of third sub-pixels corresponding to a third color, the plurality of first sub-pixels, the plurality of second sub-pixels, and the plurality of third sub-pixels arranged on the display panel to form a shape of irregular fold line having different folding lengths formed by at least two color elements contiguously; and a control module, coupled to the display panel, the control module outputting a control signal to the display panel according to a display data to drive the plurality of sub-pixels on the display panel;

wherein the sub-pixel matrix comprises 24 sub-pixels arranged in a specific order, the 24 sub-pixels comprise 8 first sub-pixels represented by A, 8 second sub-pixels represented by B, and 8 third sub-pixels represented by C, and the specific order is

ABC
CAB
ABC
BCA
ABC
BCA
ABC
CAB;

wherein the 8 second sub-pixels represented by B arranged in the specific order form a fold line comprising a first section having a first length, a second section having a second length, a third section having the first length, a fourth section having the first length and a fifth section having the second length in order and the first length is shorter than the second length.

2. The display of claim 1, wherein the sub-pixel colors are one of:

the first color is red, the second color is green, and the third color is blue;

the first color is red, the second color is blue, and the third color is green;

the first color is green, the second color is red, and the third color is blue;

the first color is green, the second color is blue, and the third color is red;

the first color is blue, the second color is green, and the third color is red;

the first color is blue, the second color is red, and the third color is green.

3. The display of claim 1, wherein the shape of fold line having different folding lengths formed by arranging the plurality of first sub-pixels, the plurality of second sub-pixels, and the plurality of third sub-pixels on the display panel is a lightning-like shape.

4. The display of claim 1, wherein an arrangement of any two adjacent rows of sub-pixels produces a stagger in the specific order.

5. The display of claim 1, wherein at least one sub-pixel among the plurality of first sub-pixels, the plurality of second sub-pixels, and the plurality of third sub-pixels of the sub-pixel matrix is replaced by at least one fourth sub-pixel corresponding to a fourth color.

6. The display of claim 5, wherein the fourth color is white.

7. A sub-pixel matrix, disposed on a display panel of a display, the display panel coupling to a control module, the sub-pixel matrix comprising:

a plurality of sub-pixels, comprising:

a plurality of first sub-pixels corresponding to a first color;

a plurality of second sub-pixels corresponding to a second color; and a plurality of third sub-pixels corresponding to a third color;

wherein the plurality of first sub-pixels, the plurality of second sub-pixels, and the plurality of third sub-pixels arranged on the display panel to form a shape of irregular fold line having different folding lengths formed by at least two color elements contiguously, the control module outputs a control signal to the display panel according to a display data to drive the plurality of sub-pixels on the display panel;

wherein the sub-pixel matrix comprises 24 sub-pixels arranged in a specific order, the 24 sub-pixels comprise 8 first sub-pixels represented by A, 8 second sub-pixels represented by B, and 8 third sub-pixels represented by C, and the specific order is

ABC
CAB
ABC
BCA
ABC
BCA
ABC
CAB:

wherein the 8 second sub-pixels represented by B arranged in the specific order form a fold line comprising a first section having a first length, a second section having a second length, a third section having the first length, a fourth section having the first length and a fifth section having the second length in order and the first length is shorter than the second length.

8. The sub-pixel matrix of claim 7, wherein the sub-pixel colors are one of:

the first color is red, the second color is green, and the third color is blue;

the first color is red, the second color is blue, and the third color is green;

the first color is green, the second color is red, and the third color is blue;

the first color is green, the second color is blue, and the third color is red;

the first color is blue, the second color is green, and the third color is red;

the first color is blue, the second color is red, and the third color is green.

9. The sub-pixel matrix of claim 7, wherein the shape of fold line having different folding lengths formed by arranging the plurality of first sub-pixels, the plurality of second sub-pixels, and the plurality of third sub-pixels on the display panel is a lightning-like shape.

10. The sub-pixel matrix of claim 7, wherein an arrangement of any two adjacent rows of sub-pixels produces a stagger in the specific order.

11. The sub-pixel matrix of claim 7, wherein at least one sub-pixel among the plurality of first sub-pixels, the plurality of second sub-pixels, and the plurality of third sub-pixels of the sub-pixel matrix is replaced by at least one fourth sub-pixel corresponding to a fourth color.

12. The sub-pixel matrix of claim 11, wherein the fourth color is white.

* * * * *